United States Patent [19]

Camilleri

[11] 4,151,992

[45] May 1, 1979

[54] DECK PAD FOR AUTOMATIC BOWLING MACHINE

[76] Inventor: Thomas M. Camilleri, 2777 Ave. W., Brooklyn, N.Y. 11223

[21] Appl. No.: 853,494

[22] Filed: Nov. 21, 1977

Related U.S. Application Data

[63] Continuation-in-part of Ser. No. 724,632, Sep. 20, 1976, abandoned, which is a continuation-in-part of Ser. No. 554,908, Mar. 3, 1975, abandoned.

[51] Int. Cl.[2] ..... A63G 1/00

[52] U.S. Cl. ..... 273/43 A; 428/64; 428/160; 428/402; 428/425

[58] Field of Search ..... 428/64, 65, 66, 80, 428/156, 157, 158, 159, 160, 306, 425, 402; 273/42 A, 43 A; 260/2.5 HA, 2.5 AK; 264/321

[56] References Cited

U.S. PATENT DOCUMENTS

| | | | |
|---|---|---|---|
| 2,817,528 | 12/1957 | Sanford | 273/42 A |
| 3,050,306 | 8/1962 | Blough | 273/42 A |
| 3,072,582 | 1/1963 | Frost | 260/33.6 UB |
| 3,094,325 | 6/1963 | Torresen et al. | 273/42 A |
| 3,341,480 | 9/1967 | Field | 260/2.5 HA |
| 3,574,150 | 4/1971 | Jefferson et al. | 428/338 |
| 3,594,335 | 7/1971 | Schultz et al. | 428/306 |
| 3,595,734 | 7/1971 | Krug | 428/315 |
| 3,717,559 | 2/1973 | Oyama et al. | 260/2.5 HA |
| 3,770,663 | 11/1973 | Ueki et al. | 260/2.5 HA |

FOREIGN PATENT DOCUMENTS

| | | | |
|---|---|---|---|
| 1230073 | 4/1971 | United Kingdom | 264/DIG. 14 |

*Primary Examiner*—William J. Van Balen
*Attorney, Agent, or Firm*—Donald J. Perrella

[57] ABSTRACT

An improved deck pad for a pinsetter automatic bowling machine is formed of medium density flexible, resilient, compression resistent cellular material.

10 Claims, 2 Drawing Figures

DECK PAD FOR AUTOMATIC BOWLING MACHINE

RELATED APPLICATION

This application is a continuation-in-part of copending application Ser. No. 724,632 filed 20 Sept. 1976 which, in turn, is a continuation-in-part of application Ser. No. 554,908, filed 3 Mar. 1975, each application now abandoned.

BACKGROUND OF THE INVENTION

This invention relates to pinsetter automatic bowling machines. More particularly, it relates to deck pads for pinsetter automatic bowling machines.

Automatic pinsetting machines are manufactured by Brunswick Corp. As described in U.S. Pat. No. 3,094,325 the mechanism for lifting and resetting the pins remaining standing after the first ball of each frame comprises an upper deck provided on its underside with circular resilient pads or discs (col. 3, lines 66–70). There are 10 deck pads, one for each pin. Engagement of a pad with the top of a standing pin holds the pin securely in position to be gripped at the neck thereof by a scissors type pick-up mechanism (col. 4, lines 8–10). The deck pad is approximately 6 inches (15.24 cm) in diameter and about 1.75 inches (4.45 cm) in height. The prior art deck pads are made of sponge rubber having a density of approximately 23 lbs.cu. ft. (0.36 g/cc). The deck pad contacts the head of the pin in resetting the pins and functions to protect the pin and to cushion the contact between deck and the pin and also to allow the scissors pick-up mechanism to grip the pin thereby to raise and lower the pin. These deck pads rapidly lose their elasticity and resilience in use, becoming hard, and suffering severe erosion due to contact with the head of the pin whereby a hole is formed in the bottom of the deck pad. The presence of a hole causes pin resetting problems. Thus, if a pin is moved from its spot, e.g. by being hit by another pin but remaining standing, it will be picked up at an angle and released at the same angle causing the pin to wobble and possibly move off its spot, or even to fall necessitating manual resetting. Further, a hole in the deck pad permits the deck to descend farther than it otherwise would. If the hole is deep enough, the pin will not compress the deck pad, the scissors pick-up mechanism will not engage and lift the pin, and the pin will be swept to the rear by the rake and treated like a pin that has been knocked down by the bowler's ball. Such a pin then must be reset manually. In addition, if the deck pad is completely worn through, the head of the pin may contact the bottom of the deck as it descends causing the plane of the deck to be tilted from horizontal. When this happens, even an uneroded deck pad without any hole will pick up the pin at an angle causing the problems mentioned above. Some of the problems associated with the prior art deck pads are described in U.S. Pat. No. 3,050,306 whose disclosure is hereby incorporated by reference. The latter patent proposed to overcome these problems by applying a replaceable nylon cover to the pin contacting surface of the pad. This proposed solution, however, has proven unsuccessful.

Other patents describing the conventional prior art deck pads are U.S. Pat. Nos. 2,646,984 and 2,817,528. The disclosures of these patents are hereby incorporated by reference.

It is, accordingly, an object of the present invention to provide an improved deck pad for pinsetter automatic bowling machines. Another object is to provide a deck pad which retains its resilience and elasticity. A further object is to provide a deck pad which does not harden in use and which resists erosion. Still another object is to provide a long lasting deck pad. These and other objects of the present invention will be apparent from the following description.

SUMMARY OF THE INVENTION

An improved respot cell pad for a pinsetter automatic bowling machine is formed of medium density, flexible, resilient, compression resistant cellular material.

DETAILED DESCRIPTION

It has now been found that all of the disadvantages of the prior art deck pads are overcome by forming these pads of flexible polyurethane foam having a medium density of from about 10 to about 18 lbs/cu. ft. (from about 0.16 to about 0.29 g/cc). The pads of the present invention are much more resilient to compression than are conventional pads despite containing less material than conventional pads as shown by their significantly lower density.

The deck pad may be formed of a unitary piece of polyurethane foam or of discrete particles of polyurethane foam which are permanently aggregated, e.g. by compression in a hydraulic press in the presence of an adhesive for polyurethane foam, to form the deck pad. The deck pad of the present invention has outstanding longevity and severicability. Whereas the prior art deck pad has an average life of 6 to 8 months, the deck pad of the present invention has a minimum service life measured in years rather than months.

The prior art deck pad in some machines has a cylindrical recess cut in its pin-contacting surface. The recess which is concentric with the circular sidewall of the deck pad is adapted to receive a plate which, when the deck pad is depressed by a pin, contacts an indicator plunger which causes a display panel to indicate pins remaining standing. The deck pad of the present invention may also be provided with a cylindrical recess in its pin-contacting surface to receive a plate, e.g. of metal or fibreboard, for installation in pin-setting machines having display panels. It has been found, however, according to the present invention that installation of the deck pad is facilitated if the cylindrical recess is not concentric with the circular sidewall of the deck pad but instead is eccentric or off-center with respect to the circular sidewall. The deck pad can then be rotated to insure that the plate engages the indicator pin.

Figure 1:
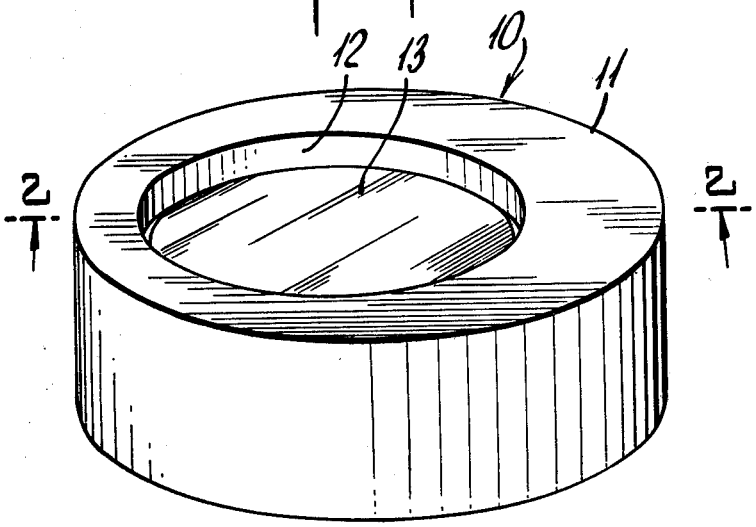
FIG. 1 is a perspective view of a deck pad.
Figure 2:
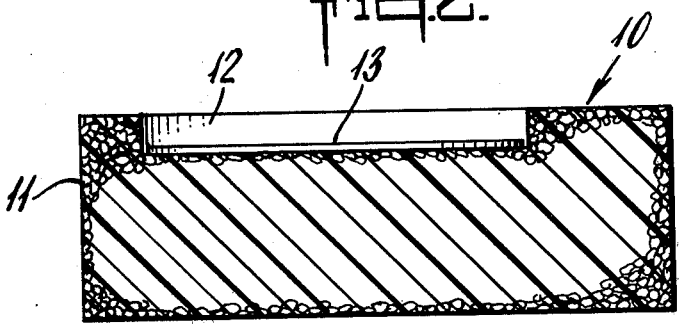
FIG. 2 is a section along the line 2—2 of FIG. 1.

FIG. 1 shows a deck pad 10 having an eccentric cylindrical recess 12. The deck pad is made of flexible foam 11. A plate insert 13, not part of the deck pad itself, fits into the bottom of recess 12.

The deck pads of the present invention maintain their resilience and gripping power during extended use and are substantially impervious to damage by machine oils and the oils used to condition the lanes of the bowling alley.

What is claimed is:

1. In a pinsetter automatic bowling machine having a resilient deck pad positioned to engage the tops of standing bowling pins when the deck is in its pin pickup position, the improvement wherein the pin contacting surface of the resilient deck pad is provided with an eccentric cylindrical recess.

2. A deck pad according to claim 1 wherein the cylindrical recess is adapted to receive a member which is adapted to contact an indicator plunger which activates a display panel.

3. A deck pad according to claim 1 made of a unitary piece of flexible foam.

4. A deck pad according to claim 1 made of aggregated discrete particles of flexible foam.

5. In a pinsetter automatic bowling machine having a resilient deck pad positioned to engage the tops of standing bowling pins when the deck is in its pin pickup position, the improvement wherein the resilient deck pad is formed of flexible polyurethane foam having a density of from about 10 to about 18 pounds per cubic foot.

6. A deck pad according to claim 5 having a density of from about 12 to about 16 pounds per cubic foot.

7. A deck pad according to claim 5 formed of a unitary piece of flexible polyurethane foam.

8. A deck pad according to claim 7 having a density of from about 12 to about 16 pounds per cubic foot.

9. A deck pad according to claim 5 formed of aggregated discrete particles of flexible polyurethane foam.

10. A deck pad according to claim 9 having a density of from about 12 to about 16 pounds per cubic foot.

* * * * *